United States Patent [19]

Blackwell

[11] 4,449,736

[45] May 22, 1984

[54] RELEASABLE TUBING STRING CONNECTOR

[75] Inventor: Henry W. Blackwell, Venus, Tex.

[73] Assignee: Dresser Industries, Inc., Dallas, Tex.

[21] Appl. No.: 331,415

[22] Filed: Dec. 16, 1981

[51] Int. Cl.[3] ..... F16L 37/08

[52] U.S. Cl. ..... 285/3; 166/115; 166/214; 285/315; 285/319

[58] Field of Search ..... 285/3, 315, 319; 166/115, 125, 214, 136

[56] References Cited

U.S. PATENT DOCUMENTS

| | | | |
|---|---|---|---|
| 2,409,811 | 10/1946 | Taylor, Jr. et al. | 166/10 |
| 2,961,047 | 11/1960 | Medford, Jr. | 166/123 |
| 3,102,594 | 9/1963 | Crowe | 166/214 X |
| 3,559,732 | 2/1971 | Tucker | 166/114 |
| 4,040,649 | 8/1977 | Blackwell | 285/3 |
| 4,315,544 | 2/1982 | Monauni et al. | 166/214 |

*Primary Examiner*—Thomas F. Callaghan
*Attorney, Agent, or Firm*—William R. Peoples

[57] ABSTRACT

A connector for releasably securing an upper section of a tubing string to a lower section includes a tubular housing containing a retaining sleeve with a collet telescoped therein and having a plurality of spring fingers interlocked with a mating section on a tubular stinger. A shoulder on the stinger serves to engage the top of the retaining sleeve and move it into a release position when setting down on the tubing string with the lower section of the string anchored in the well. The retaining sleeve is held in this position by catch means acting between the sleeve and the housing and thereby locates a recess in the sleeve to allow the spring fingers of the collet to release from the stinger as the latter thereafter moves upwardly when pulling the upper section of the tubing string from the well.

7 Claims, 3 Drawing Figures

RELEASABLE TUBING STRING CONNECTOR

TECHNICAL FIELD

The invention relates to a releasable connector such as may be used in a tubing string to connect an upper section of the tubing string in a well to a lower section anchored in the well, the connector being releasable to permit removal of the upper section from the well without also having to remove the lower section.

BACKGROUND ART

In service use, a releasable tubing string connector typically must be able to withstand the effect of substantial tension in the tubing string such as may occur when setting a packer or other well tool. Additionally, the connector must be able to withstand some lesser magnitude of compressive load such as may occur when the tubing strikes or catches upon something as it is lowered into the well. But, the connector also must easily release from the lower section of the tubing string when it is desired to pull the upper section of the string from the well so as to avoid possibly damaging joints in the tubing or the seal between the packer and the well casing.

Prior connectors such as those described in U.S. Pat. Nos. 2,409,811, 3,559,732 and 4,040,649 have utilized various forms of piston and releasable latching arrangements to effect a releasable connection between telescoped tubular members connecting between upper and lower sections of a tubing string. In these prior patented devices, operation of the connectors is pressure dependent, either on the pressure internal to the tubing or the pressure in the annulus between the tubing and the casing above the packer.

DISCLOSURE OF INVENTION

The present invention aims to provide a new and improved releasable tubing string connector which is operable independently of the pressure in either the tubing string or the annulus and yet which allows for easy separation of the upper and lower sections of the tubing string by means of an upward pull on the upper section of the tubing string once the lower section is anchored in the well. More particularly, the present invention aims to achieve the foregoing while still providing a connector which will withstand both the tensile and compressive loads normally expected of prior releasable connectors.

More specifically, the invention herein resides in the novel construction of the connector with a collet member for connecting together the upper and lower sections of the tubing and a mechanically actuated retaining sleeve for supporting the collet in a latched position and with a shear pin supporting the sleeve against movement into a release position. With this construction, the connector may be easily released by setting down on the upper section of the tubing string to shear the pin and then picking upon the tubing string to pull the upper section from the well.

The foregoing and other advantages of the present invention will become more apparent from the following description of the best mode of carrying out the invention when taken in conjunction with the accompanying drawings.

BEST MODE OF CARRYING OUT THE INVENTION

Figure 1:
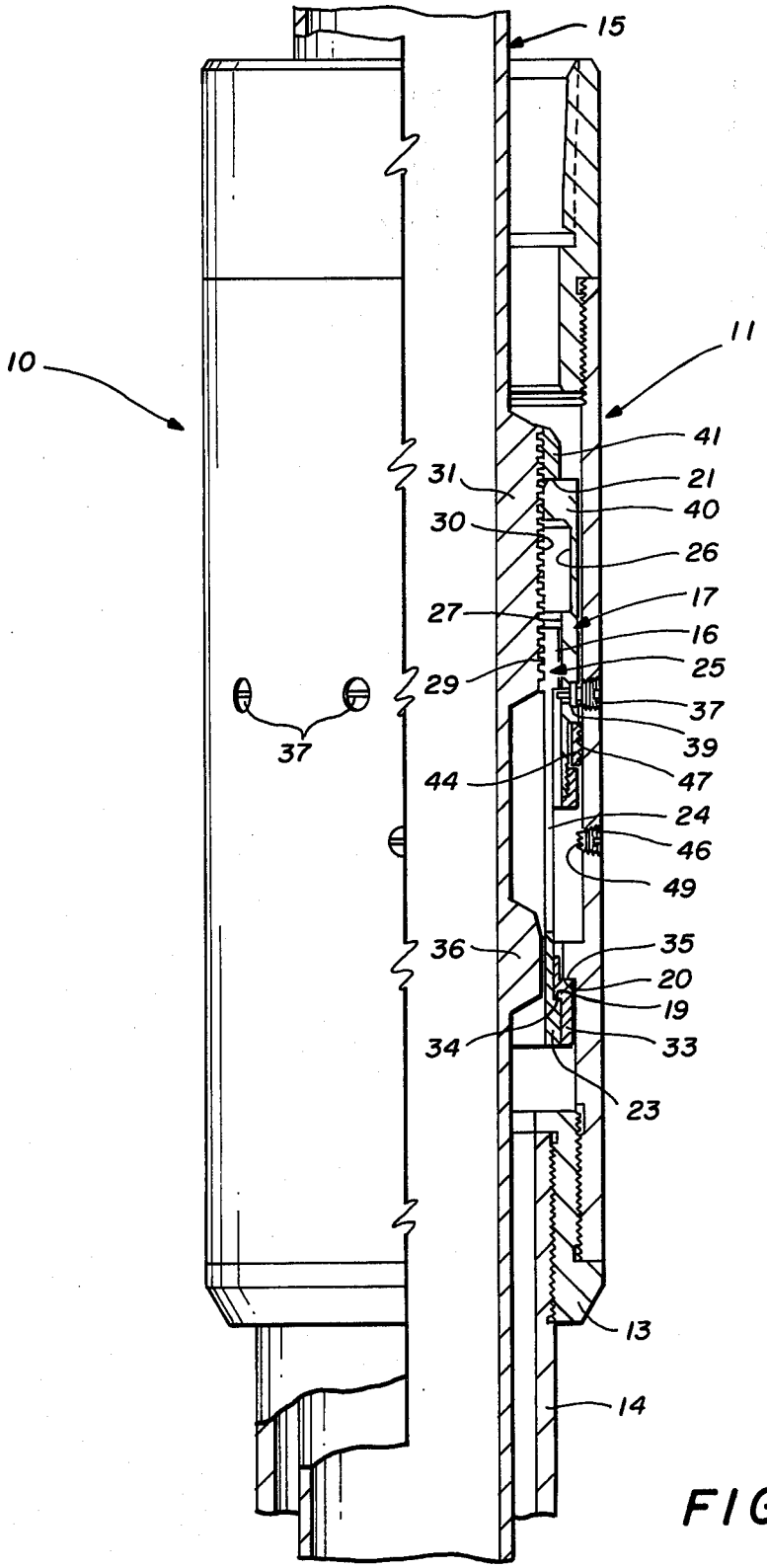
FIG. 1 is a combined elevational and cross-sectional view of a releasable tubing connector embodying the novel features of the present invention.
Figure 3:
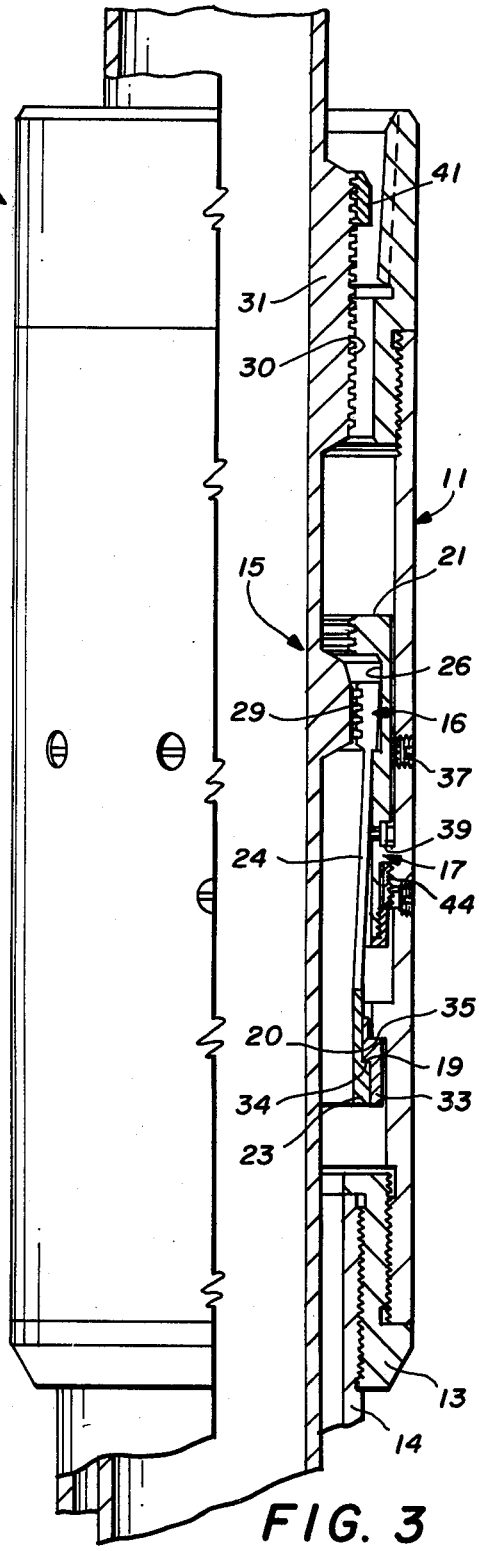

As shown in the drawings for purposes of illustration, the present invention is embodied in a releasable connector 10 such as may be utilized typically between upper and lower sections of a tubing string (not shown) to permit removal of the upper section from a well while leaving the lower section in place. Herein, the connector includes a tubular housing 11 with a lower end fitting 13 providing for threaded connection to the upper end portion of a receptacle 14 or the like secured to the lower section of the tubing string. A tubular stinger 15 (partially shown in the drawings) is sized to fit within the housing and includes an upper end portion (not shown) for connection to the upper section of the tubing string and a lower end portion (not shown) adapted for sealing engagement with the inside surface of the receptacle 14. With the stinger telescoped into the housing, a latching member 16 and a retaining sleeve 17 coact with the stinger to support the latter against separation from the housing thereby serving to couple the upper and lower sections of the tubing string together. To release the stinger 15 for removal from the housing, the retaining sleeve is movable from a locking position as shown in FIG. 1 into a release position as shown in FIG. 3 thereby freeing the latching member from the stinger so that the latter may be pulled upwardly out of the housing 11.

In accordance with the primary aim of the present invention, the exemplary connector 10 is constructed in a novel manner enabling the stinger 15 to be released easily from the housing 11 independently of the application of pressure to any of the components of the connector while still providing the strength necessary for withstanding expected compressive and tensile loads as might be experienced in running the tubing string into the well and during anchoring the lower section of the tubing string in a desired location. For these purposes, abutting upwardly and downwardly facing shoulder means 19 and 20 on the latching member 16 and housing 11, respectively, keep the stinger 15 from being pulled free from the housing when the retaining sleeve 17 is in its locking position. Additionally, an abutment surface 21 on the stinger is engagable with the retaining sleeve 17 when lowering the stinger in the housing so as to shift the retaining sleeve into its release position and thereby free the latching member 16 to release from the stinger when the latter thereafter is lifted as the upper section of the tubing string is pulled from the well. By virtue of this arrangement, the upper section of the tubing string may be removed from the well while leaving the lower section in place and this may be accomplished through simple manipulation of the tubing string without having to apply pressure to either the annular area between the tubing string and the well casing or through the interior of the tubing string.

In the present instance, the latching member comprises a collet 16 with an annular base section 23 having angularly spaced spring fingers 24 integrally formed therewith and extending upwardly therefrom within the housing 11. The fingers are spring biased radially outward and extend upwardly into the retaining sleeve 17 with free ends 25 of the fingers positioned beneath an annular recess 26 formed in the inner surface 27 of the retaining sleeve so that such surface blocks the free ends of the fingers against movement radially outward when the sleeve is in its locking position (FIG. 1). A number of longitudinally spaced teeth 29 are formed in the inner surface of each spring finger and these teeth mate with a corresponding helical groove 30 formed in a radially enlarged section 31 of the stinger 15 as is shown in FIG. 1 to connect the collet 16 and stinger 15 together.

To connect the collet 16 with the housing 11 so as to support the weight of the lower section of the tubing string and to transmit tensile forces through the connector 10 to the lower section of the tubing such as for setting a packer (not shown) or the like to anchor the lower section of the tubing in the well, the shoulder means 19 and 20 includes a first upwardly facing annular shoulder 19 formed on the collet base section 23 and extending radially outward therefrom. Captured on this shoulder is a ring member 33 having a first downwardly facing shoulder 34 abutting the upwardly facing shoulder 19 of the base and a second upwardly facing annular shoulder 35 spaced radially outward of the first upwardly facing shoulder 19. Herein, the ring member is split for ease of assembly and the upwardly facing shoulder 35 of the ring member abuts the other shoulder means 20 which herein comprises a radially inwardly projecting and second downwardly facing annular shoulder 20 integrally formed with the inside surface of the housing. In this manner, the base 23 of the collet 16 connects with the housing 11 to support the weight of the lower section of the tubing string. As a safety measure against radially inward collapse of the base 23 of the collet, the stringer 15 includes an annular land 36 protruding outwardly from the stinger adjacent the abutting shoulders 19 and 34 and 35 and 20.

Figure 2:
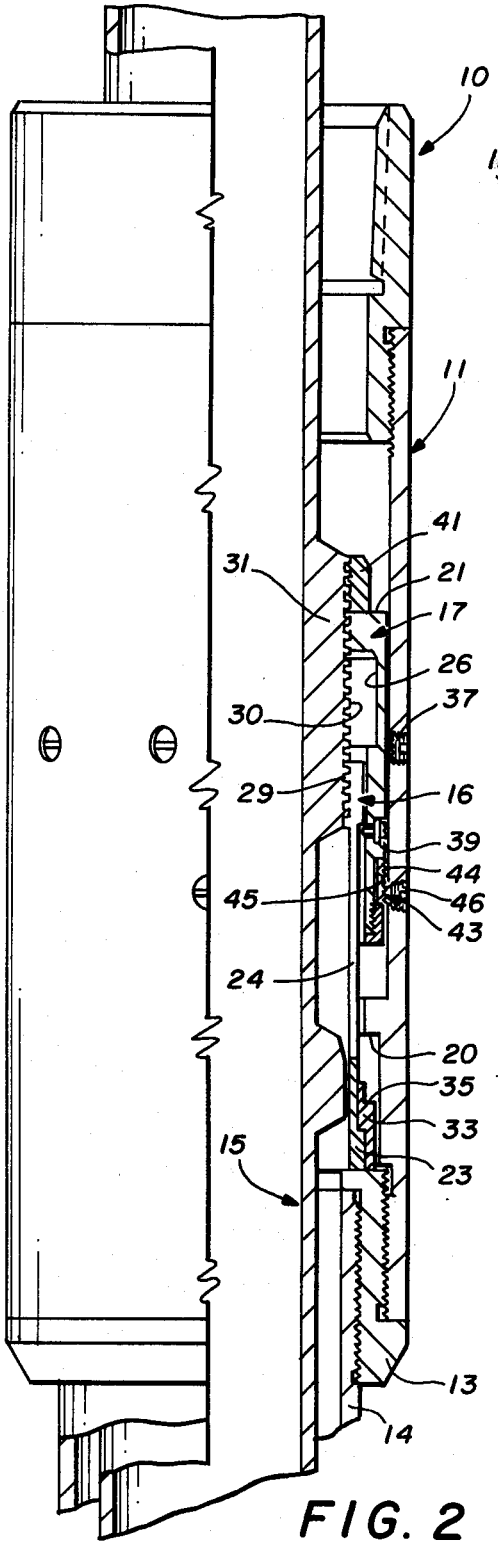
FIGS. 2 and 3 are views similar to FIG. 1, but showing parts of the connector in moved positions.

Supporting the retaining sleeve 17 in its locking position are a plurality of frangible members or shear screws 37 secured to the housing 11 and extending radially inwardly therefrom into associated recesses 39 in the outer surface of the retaining sleeve. For shifting the retaining sleeve downwardly from its latching position and into its release position, the upper end of the retaining sleeve includes an enlarged annular portion 40 extending radially inward to a position spaced slightly outward of the stinger groove 30. Threaded onto an upper portion of the enlarged stinger portion 40 is a load nut 41 whose underside defines the abutment surface 21 and is engagable with the upper end 40 of the retaining sleeve. By virtue of this arrangement, it may be seen that once the lower section of the tubing string is anchored in the well, setting down on the tubing string will cause the load nut to transmit weight through the shear screws 37. With sufficient force, the screws fracture and the retaining sleeve 17 will slide downwardly within the housing into a sheared postion as is shown in FIG. 2. The sleeve is held in this position by catch means 43 coacting between the sleeve and the housing. Herein, the catch means comprises a split ring spring 44 captured within an outwardly facing annular groove 45 in the lower end portion of the sleeve and a plurality of screws 46 connected to and protruding inwardly from the housing. Frictional engagement between the split ring spring and the screws is enhanced by toothed surfaces 47 and 49 on the outer surface of the ring ring 44 and the inward ends of the screws, respectively.

Once the retaining sleeve 17 is located in its release position, the stinger 15 may be removed from the connector housing 11 by simply pulling up on the upper section of the tubing string. As the stinger is moved upwardly, the collet 16 is carried upwardly until the free ends 25 of the spring fingers 24 are aligned radially with the annular recess 26 in the retaining sleeve. In this position, the fingers are free to flex radially outward with the teeth 29 disengaging from the helical groove 30 on the stinger thereby allowing the stinger to be pulled free from the housing.

In view of the foregoing, it will be appreciated that the releasable tubing connector 10 of the present invention enables easy straight pull removal of the upper section of the tubing string from the well without having to rely upon pressure to operate the connector to release while still providing the strength necessary to withstand the compressive and tensile forces that one might expect to encounter when lowering the tubing string into the well and anchoring the lower section of the string in place. Advantageously, herein, the shear screws 37 acting between the retaining sleeve 17 and the connector housing 11 provide resistance against low mangnitude compressive forces that might be encountered in lowering the tubing in the well. In the opposite direction, tensile strength through the connctor is provided through the mated teeth 29 and groove 30 of the collet and stinger, respectively and the abutting shoulders 19 and 34 and 35 and 20 acting between the base 23 of the collet and the housing 11. And, easy release of the connector is achieved by virtue of the abutting of the load nut 41 with the top 40 of the retaining sleeve 17 when setting down on the tubing string so as to shift the retainer sleeve into its release position allowing the stinger to be pulled free from the housing.

The embodiments of the invention in which an exclusive property or privilege is claimed are defined as follows:

1. A connector for releasably latching an upper section of a tubing string to a lower section including a tubular housing, a retaining sleeve mounted within said housing, said sleeve having an inner surface with an annular recess formed therein, a shear pin connected between said housing and said retaining sleeve and supporting said sleeve in a locking position, catch means on said housing and said sleeve for acting between said housing and said sleeve to support said sleeve in a release position within said housing spaced from said locking position, a latching member telescoped within said retaining sleeve including an upwardly facing shoulder formed at one end thereof, a corresponding downwardly facing shoulder formed in said housing and connected to abutting said upwardly facing shoulder to support said latching member against being pulled upwardly out of said housing, said latching member further including a plurality of spring biased elements extending radially inward therefrom, a stinger telescoped into said housing and including a latch section disposed within said latching member and mated with said elements with said inner surface of said retaining sleeve blocking said elements against radial movement out of engagement with said stinger when said sleeve is in its locking position, a bearing shoulder on said stinger engagable with said retaining sleeve to shift said sleeve downwardly and shear said pin when setting down on said tubing string to thereby shift said retaining sleeve into its release position with said elements being free to move radially out of said mating engagement with said stinger into said annular recess when said retaining sleeve is in its release position to enable said stinger to be pulled out of said housing.

2. A connector as defined by claim 1, wherein said latch section on said stinger comprises a threaded section and said stinger shoulder is defined by a load nut threaded onto said threaded section.

3. A connector as defined by claim 1 wherein said catch means includes an externally-toothed split-ring spring mounted within an annular groove formed in the outer surface of said retaining sleeve and biased radially outward toward the inner surface of said housing, and a screw with a toothed inner end portion extending through said housing to catch against said split-ring when said sleeve is moved into its release position thereby to support said sleeve in such position.

4. A connector as defined by claim 1 wherein said latching member comprises a collet with a plurality of angularly-spaced spring fingers extending upwardly from an integral annular base section, each of said spring fingers having toothed inner surfaces thereon, said latch section on said stinger being defined by a groove adapted to receive at least one of the inner surfaces to releasably hold said stinger and said collet together.

5. A connector as defined by claim 4 including a split ring member mounted on said base section around the periphery thereof, said ring and said base section including abutting surfaces keeping said ring from being moved downwardly off of said base section, said upwardly facing support shoulder being formed on said split ring member for abutting engagement with said corresponding shoulder on said housing.

6. A connector as defined by claim 5 further including an annular land integrally formed with said stinger and protruding radially outward therefrom toward said base section of said collet when said stinger is coupled together with said housing to keep said base section from deflecting radially inward.

7. A connector for releasably latching an upper section of a tubing string to a lower section in a well including a tubular housing connectable to said lower section, a retaining sleeve mounted within said housing, said sleeve having an inner surface with a recess formed therein, a frangible member connected between said housing and said retaining sleeve and supporting said sleeve in a locking position, catch means on said housing and said sleeve for acting between said housing and said sleeve to support said sleeve within well housing in a release position within said housing spaced from said locking position, a latching member telescoped into said retaining sleeve including upwardly facing shoulder meansformed at one end thereof, corresponding downwardly facing shoulder means on said housing and connected to said upwardly facing shoulder means to support said latching member against being pulled upwardly out of said housing, said latching member further including a plurality of spring biased elements extending radially inward therefrom, a stinger connectable with said upper section of said tubing string telescoped into said housing and including a latching section mated with said elements with said inner surface of said retaining sleeve blocking said elements against radial movement out of mating engagement with said stinger when said sleeve is in its locking position, an abutment surface on said stinger engagable with said retaining sleeve when setting down on said tubing string to shear said frangible member and thereby shift said retaining sleeve into its release position so as to free said latching member elements to move out of mating engagement with said latching section and into said retaining sleeve recess when said sleeve is in its release position to enable said stinger to be disconnected from said housing by thereafter pulling said upper section of the tubing string from the well.

* * * * *